United States Patent [19]

Oliff et al.

[11] Patent Number: 4,732,316

[45] Date of Patent: Mar. 22, 1988

[54] SUSPENDIBLE CARTON WITH END CLOSURE STRUCTURE

[75] Inventors: James R. Oliff, Austell; Gary W. Baugus, Atlanta, both of Ga.

[73] Assignee: The Mead Corporation, Dayton, Ohio

[21] Appl. No.: 68,241

[22] Filed: Jun. 30, 1987

[51] Int. Cl.[4] ..... B65D 25/30

[52] U.S. Cl. ..... 229/40; 206/427; 206/806; 229/52 B

[58] Field of Search ..... 229/40, 52 B, 52 BC; 206/427, 434, 806; 248/220.3, 220.4

[56] References Cited

U.S. PATENT DOCUMENTS

| | | | |
|---|---|---|---|
| 2,990,096 | 6/1961 | Crosby | 229/15 |
| 3,066,795 | 12/1962 | Mansfield | 229/40 |
| 4,029,207 | 6/1977 | Gordon | 229/40 |
| 4,106,615 | 8/1978 | Hiroshi | 206/806 |
| 4,128,169 | 12/1978 | Arneson | 229/40 |
| 4,451,001 | 5/1984 | Webinger | 229/40 |

FOREIGN PATENT DOCUMENTS

| | | | |
|---|---|---|---|
| 986063 | 3/1976 | Canada | 229/40 |
| 1424536 | 12/1965 | France | 229/40 |
| 736218 | 9/1955 | United Kingdom | 206/427 |

*Primary Examiner*—Stephen Marcus
*Assistant Examiner*—Gary E. Elkins
*Attorney, Agent, or Firm*—Rodgers & Rodgers

[57] ABSTRACT

A carton formed from a unitary blank includes a top wall, a pair of side walls and a composite bottom wall foldably adjoined along their side edges to form a tubular structure is provided with an end panel foldably joined to an end edge of the top wall at one end of the carton and which is folded into flat face contacting relation with the inner surface of the top wall together with a door panel foldably joined to the end edge of each side wall at one end of the carton and interconnected with the adjacent end edge of the end panel by a web panel foldably joined to each end of the end panel and to an adjacent edge of a side wall.

5 Claims, 6 Drawing Figures

SUSPENDIBLE CARTON WITH END CLOSURE STRUCTURE

TECHNICAL FIELD

This invention relates to cartons for packaging a plurality of articles and is specially adapted for suspension from a hanger such as might be disposed on a meat rack.

BACKGROUND ART

U.S. Pat. No. 3,679,122 issued July 25, 1972 and owned by the assignee of this invention discloses a carton having a top wall, a pair of side walls and a composite bottom wall foldably joined to form a tubular structure. This patent also discloses end panels foldably joined to the end edges of the top wall and secured in vertical relation to the top wall by web structure foldably joined to the side walls and arranged to manipulate the end panel into vertical position. This patent does not disclose suspension structure whereby the carton may be supported on a hanger such as might be included within a meat rack. This carton also does not disclose door panels.

SUMMARY

According to this invention in one form, a carton formed from a unitary blank includes a top wall, a pair of side walls and a composite bottom wall foldably adjoined along their side edges to form a tubular structure together with an apertured end panel foldably joined to the end edge of the top wall at one end of the carton and folded into flat face contacting relation with the inner surface of the top wall together with a door panel foldably joined to the end edges of the side walls respectively at one end of the carton and interconnected by web panels foldably joined to the end edges of the end panel respectively and to the top edges of the side walls. The aperture in the end panel is disposed in coincidence with an aperture in the top wall.

BEST MODE OF CARRYING OUT THE INVENTION

Figure 1:
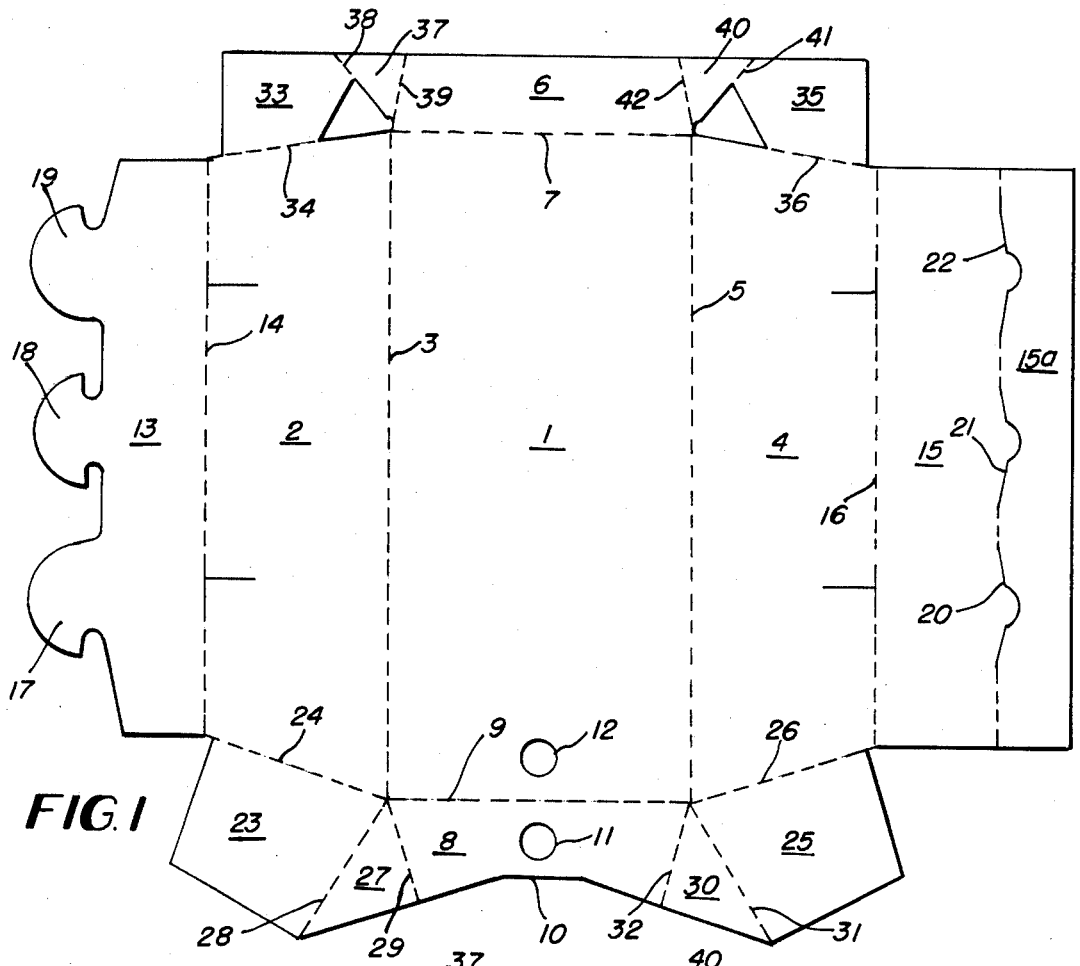
FIG. 1 is a plan view of a unitary blank from which a carton according to this invention is formed and which shows the blank from the outside.

With reference to FIG. 1, the numeral 1 designates the top wall of the carrier. A side wall 2 is foldably joined to top wall 1 along fold line 3 while side wall 4 is foldably joined to top wall 1 along fold line 5. An end panel 6 is foldably joined to an end edge 7 of top wall 1 while an end panel 8 is foldably joined to top wall 1 along a fold line 9. End panel 8 has a specially configured edge 10 and is provided with an aperture 11 which coincides with an aperture 12 formed in top wall 1 when end panel 8 is folded inwardly through 180 degrees into flat face contacting relation with the inside surface of top wall 1.

The bottom wall of the carton is a composite structure including bottom panel 13 foldably joined to side wall 2 along fold line 14 together with bottom panel 15 foldably joined to the bottom edge of the side wall 4 along fold line 16. Locking tabs 17, 18 and 18 are formed along one edge of panel 13 and cooperate respectively with locking slots 20, 21 and 22 in known manner, the side portion 15*a* of panel 15 is disposed inside panel 13 when the carton is set up.

A door panel 23 is foldably joined to side wall 2 along fold line 24 while end closure door 25 is foldably joined to side wall 4 along fold line 26. A web panel 27 is foldably joined to end door panel 23 along a fold line 28 and to the end edge of end panel 8 along fold line 29. Similarly web panel 30 is foldably joined to end closing door panel 25 along fold line 31 and to the adjacent end edge of end panel 8 along fold line 32.

At the other end of the carton, a flap 33 is foldably joined to end wall 2 along fold line 34 and a flap 35 is foldably joined to side wall 4 along fold line 36. A web panel 37 is interconnected with flap 33 along short fold line 38 and to an end edge of end panel 6 along fold line 39. Similarly a web panel 40 is foldably joined to flap 35 along short fold line 41 and to an end edge of end panel 6 along fold line 42.

Figure 3:
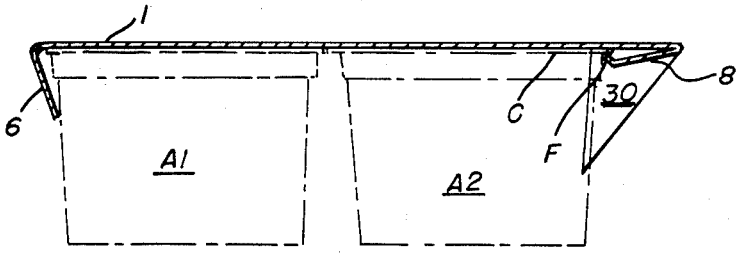
FIG. 3 is a cross sectional view taken along the line designated 3—3 in FIG. 2.

The articles such as A1 and A2 preferably though not necessarily are configured as best shown in FIG. 3 and include a narrow flange F which serves as a surface to which the article cover C is secured as best shown in FIG. 3.

Figure 2:
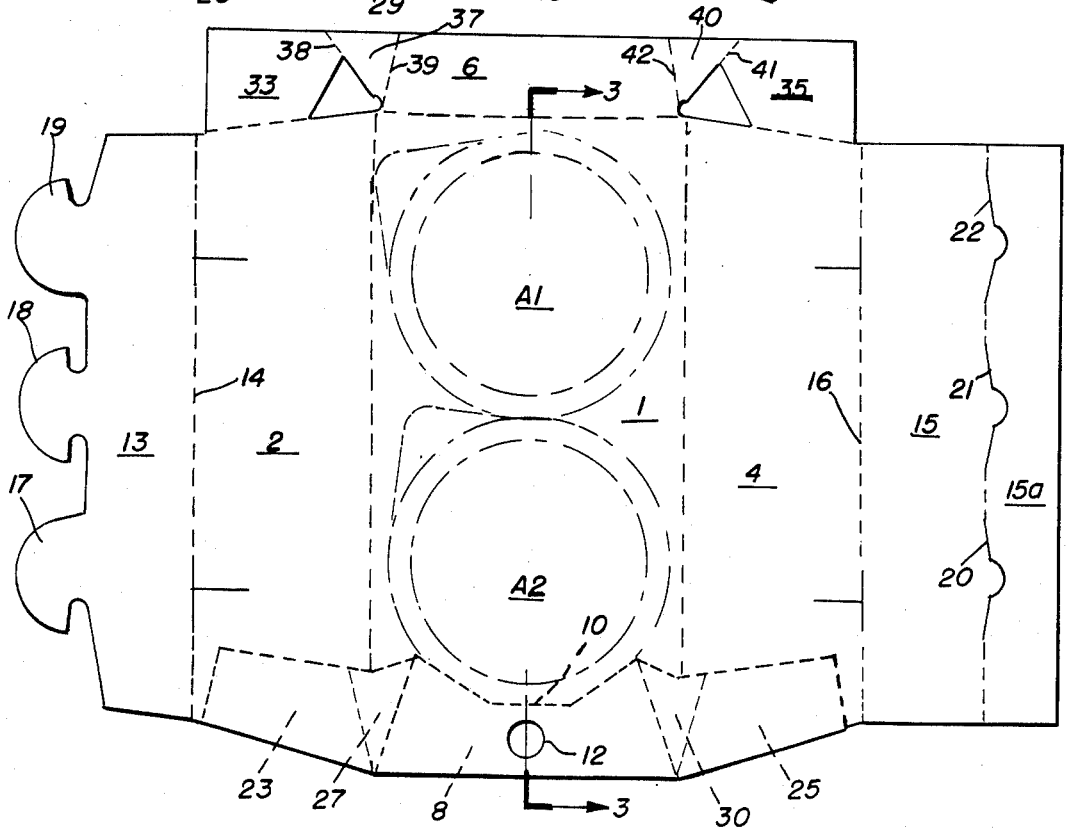
FIG. 2 is a view similar to FIG. 1 but which shows in phantom lines a pair of packaged articles disposed below the blank together with an end panel folded into flat face contacting relation with the inside of the top wall together with associated structure including web panels and door panels at one end of the blank.
Figure 4:
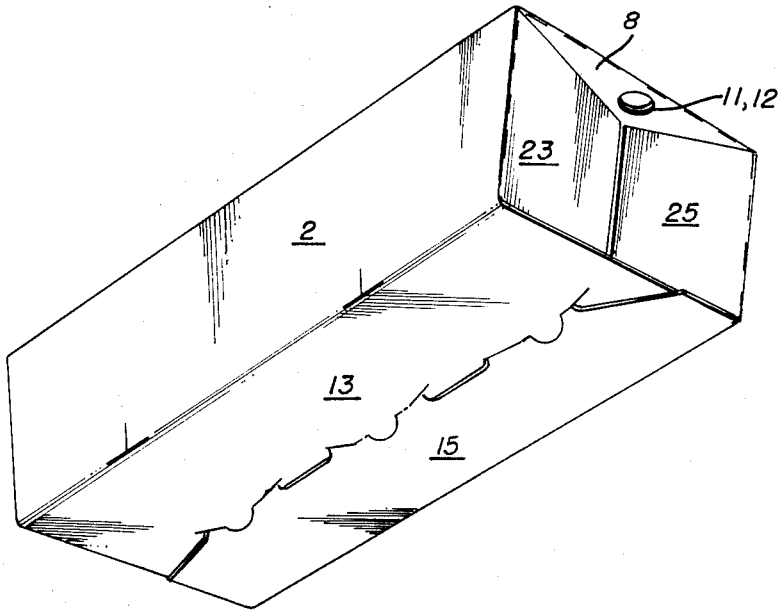
FIG. 4 is a perspective view from below and from the vantage point of an end of the carton including hanger structure and end closing doors.

In order to assemble the package, the articles such as A1 and A2 are arranged in side by side relation and the blank such as is shown in FIG. 1 is placed atop these articles as shown in FIG. 2 and the end panel 8 is folded downwardly and inwardly through approximately 180 degrees into a position of flat face contacting relation with the inside surface of top wall 1. This movement causes aperture 11 to come into coincidence with aperture 12. This same folding operation swings the door panels 23 and 25 into a position of angular relationship with respect to the side walls 2 and 4 respectively as shown in FIG. 2. Of course this action is effected by virtue of the interconnection provided by web panels 27 and 30 between the end edges of the end panel 8 and the top edges such as 28 and 31 of end closure door panels 23 and 25. Thereafter downward folding of side walls 2 and 4 into their normal fully set up condition swings the end closing doors 23 and 25 into closed positions and swings web panels 27 and 30 into flat face contacting relation to said end panel while exposing apertures 11, 12 as best shown in FIG. 4. Folding of end panel 6 to a position approximately normal to top wall 1 and folding the flaps 33 and 35 into contact with the side walls 2 and 4 is not shown in detail but is a well known procedure and serves as article retaining means to prevent dislodgement of articles through the end of the carton.

Thereafter the panels 13 and 15 are folded underneath the articles A1 and A2 and the locking tabs 17, 18, and 19 are inserted into the locking slots 20, 21 and 22 in a manner which is well known.

Figure 6:
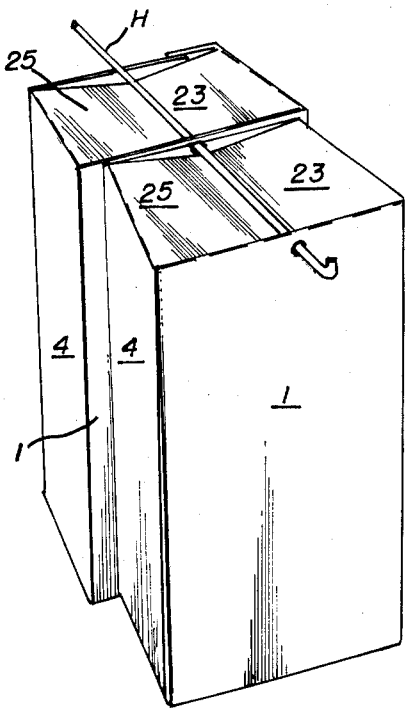
FIG. 6 is a view of a hanger on which a pair of cartons constructed according to this invention are suspended.
Figure 5:
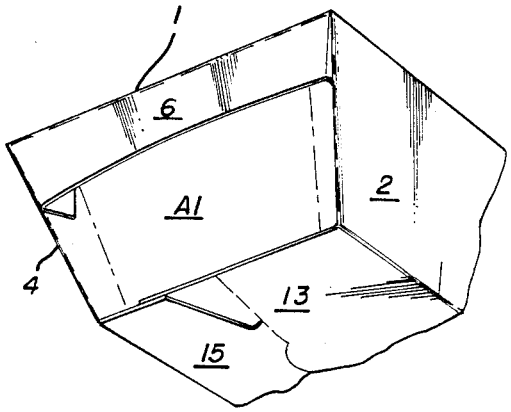
FIG. 5 is a view of the opposite end of the carton from that depicted in FIG. 4.

The completed carton as shown in FIGS. 4 and 5 is specially adapted according to a feature of this invention for suspension on a hanger such as is indicated in FIG. 6 at H. The articles are supported on hanger H by simply swinging the articles into position with the hanger H inserted through the aperture defined by openings 11 and 12 which as explained are coincident.

Of course the packaged items when suspended as shown in FIG. 6 are disposed on their sides so that products packaged within the containers A1 and A2 tend to settle and when viewed by a prospective purchaser makes the containers A1 and A2 appear to be only partially full where the containers are transparent. Thus the end closing doors such as 23 and 25 effectively close the end of the carton and thus tend to improve the overall appearance of the finished package.

Of course this package is not limited for use in connection with a hanger such as H but may also be displayed on the shelves of retail outlets.

We claim:

1. A carton for packaging articles and formed from a unitary blank comprises a top wall, a pair of side walls and a composite bottom wall foldably joined along their side edges to form a tubular structure and is provided with an end panel foldably joined to an end edge of said top wall at one end of the carton and folded inwardly toward the other end of the carton and into flat face contacting relation with the inner surface of the top wall, said end panel having an inner edge remote from said end edge of said top wall and having an aperture which is in coincidence with a corresponding aperture in said top wall for receiving a carton suspending hanger, a pair of end closing doors foldably joined respectively to the end edges of said side walls at said one end of the carton and arranged to expose said apertures when closed, and a web panel disposed in flat face contacting relation to said end panel and foldably joined to each end edge of said end panel and to the adjacent end edge of each of said end closing doors.

2. A carton according to claim 1 wherein folding said end panel into flat face contacting relation with said top wall and manipulating the blank while disposed in overlying relation to the articles by folding said side walls downwardly causes said end closing doors to swing into their closed positions.

3. A carton according to claim 1 wherein the upper ends of the articles are flanged and wherein the inner edge of said end panel is disposed below and in engagement with the flange of an adjacent article.

4. A carton according to claim 1 wherein article retaining means is disposed at the other end of the carton.

5. A carton for packaging articles and formed from a unitary blank comprises a top wall, a pair of side walls and a composite bottom wall foldably joined along their side edges to form a tubular structure, said carton comprising an end panel foldably joined to an end edge of said top wall at one end of the carton and folded inwardly into flat face contacting relation with the inner surface of the top wall, said end panel having an aperture which is in coincidence with a corresponding aperture in said top wall for receiving a carton suspending hanger, a pair of end closing doors foldably joined respectively to the end edges of said side walls at said one end of the carton, and a web panel foldably joined to each end edge of said end panel and to the adjacent one of said end closing doors so that folding said end panel into face contacting relation with said top wall swings said end closing doors partially toward closed positions while said side walls are disposed in substantially the same plane as said top wall and folding said side walls out of the plane of said top wall and downwardly to their final positions swings said end closing doors into their final end closing positions and swings said web panels into flat face contacting relation with said end panel.

* * * * *